US006478611B1

(12) United States Patent
Hyland

(10) Patent No.: US 6,478,611 B1
(45) Date of Patent: Nov. 12, 2002

(54) ELECTRICAL CONNECTOR WITH VISUAL INDICATOR

(75) Inventor: James Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/035,295

(22) Filed: Nov. 8, 2001

(51) Int. Cl.[7] ..... H01R 3/06
(52) U.S. Cl. ..... 439/490
(58) Field of Search ..... 439/490, 676, 439/607, 609

(56) References Cited

U.S. PATENT DOCUMENTS 4,978,317 A * 12/1990 Pocrass ..... 439/490
5,685,737 A * 11/1997 Morin et al. ..... 439/490
5,704,802 A * 1/1998 Loudermilk ..... 439/490
6,142,822 A * 11/2000 Wu ..... 439/490
6,174,194 B1 * 1/2001 Bleicher et al. ..... 439/490
6,217,371 B1 * 4/2001 Wu ..... 439/490
6,319,062 B1 * 11/2001 Ma et al. ..... 439/490

* cited by examiner

*Primary Examiner*—Gary F. Paumen
(74) *Attorney, Agent, or Firm*—Wei Te Chung

(57) ABSTRACT

An RJ type modular connector (1) comprises an insulative housing (10), a terminal insert assembly (20) retained in the housing, a pair of LED modules (30) and a conductive shield (40) covering on the housing. The housing defines a pair of channels (112) in both sides thereof and forms a pair of blocks (16) located below the channels 112, each block defining a hole (164). Each LED module includes a fixture member (38) molded with lead wires (34, 36). The fixture member forms a vertical portion (382) combining with the lead wires and a horizontal portion (384) for being captured by a corresponding hole of the housing to safely retain the LED module in the housing.

19 Claims, 12 Drawing Sheets

ELECTRICAL CONNECTOR WITH VISUAL INDICATOR

BACKGROUND OF THE INVENTION

1. Field of the Invention

The present invention relates to an electrical connector having a visual indicator, and particularly to a modular receptacle jack having a Light-Emitting Diode (LED) to provide a visual verification of a connection formed by the modular receptacle jack.

2. Description of Prior Art

A modular receptacle jack, also known as an RJ connector, is commonly used in telecommunication and data networking equipments. An RJ connector typically forms a link between two pieces of equipment to provide a means of communication between the two pieces of equipment. In order to ensure the integrity of the link, it has been a practice in the industry to use a LED module located separately from the link to provide visual status regarding the connection. RJ connectors having such LED modules are disclosed in U.S. Pat. Nos. 4,978,317, 5,685,737 and 5,704,802, wherein an LED module always is in an "L" shape and comprises a vertical portion and a horizontal portion both of which are inserted into corresponding channels defined in the connector. However, the LED module is not provided with an alignment or stabilization means to ensure the LED module is steadily and safely retained in the RJ connector, therefore, the LED module may then move or become loose during assembly or transportation.

Hence, an RJ connector having an improved LED module is required to overcome the disadvantages of the prior art.

BRIEF SUMMARY OF THE INVENTION

A first object of the present invention is to provide an RJ type modular connector having an LED module safely retained in housing thereof;

A second object of the present invention is to provide an RJ type modular connector having an LED module which is easy to be assembled or disassembled from the housing thereof.

An RJ type modular connector in accordance with the present invention is adapted for receiving a plug to form an electrical connection in data communication application. The connector comprises an insulative housing, a terminal insert assembly retained in the housing for mating with the plug, a pair of LED modules and a conductive shield covered on the housing thereof. The housing has a top wall, a partition block extending upwardly from the top wall and a pair of side walls extending over the top wall which cooperatively define a pair of channels. A pair of blocks extend rearward from the housing and each defines a hole at a rear face thereof. The LED modules are fitted in the channels of the housing to provide visual verification of a status of the electrical connection. Each LED module includes a visual indicator, lead wire side-by-side extending from the visual indicator and received in a corresponding channel of the housing, and a fixture member molded with the lead wires. The fixture member forms a vertical portion combining the lead wires together and a horizontal portion perpendicular to the vertical portion to be captured by a corresponding hole of the housing to safely retain the LED in the housing. Furthermore, the LED modules are assembled with the housing before or after the conductive shield is covered onto the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
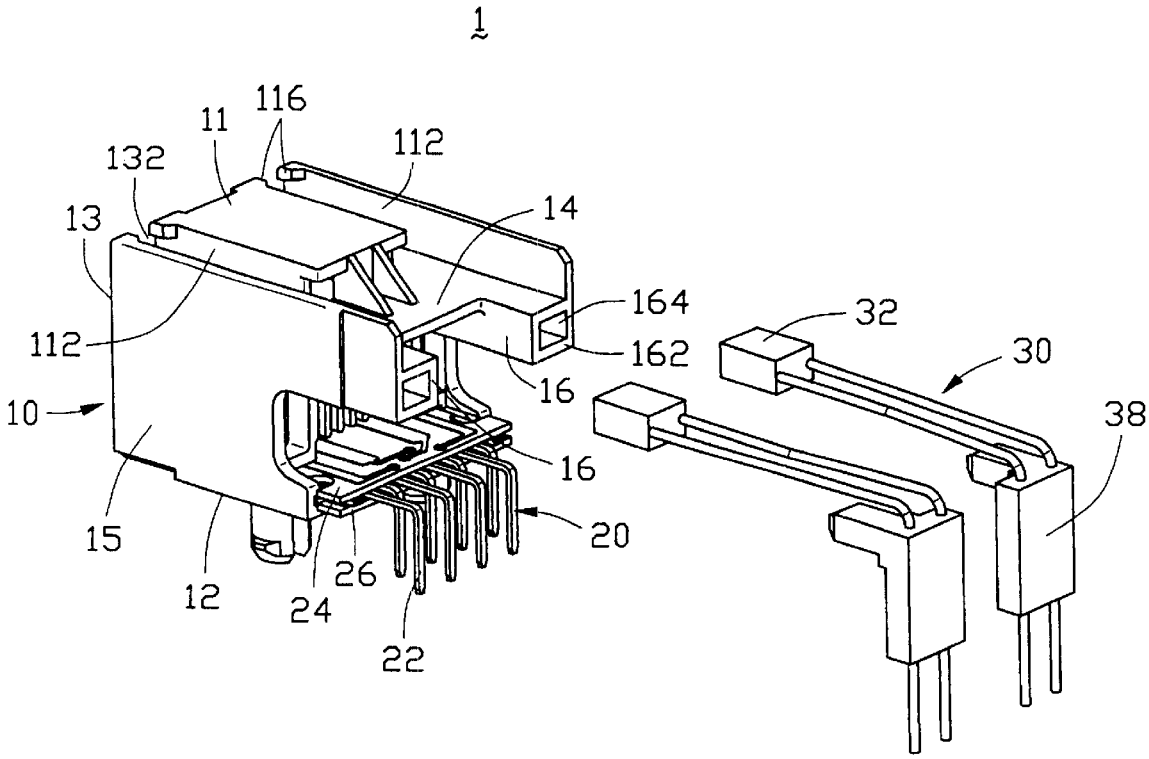
FIG. 1 is an exploded perspective view of an electrical connector in accordance with a first embodiment of the present invention.

Referring to FIG. 1, an RJ type modular connector 1 in accordance with a first embodiment of the present invention comprises a dielectric housing 10, a terminal insert assembly 20 held in the dielectric housing 10, a pair of LED modules 30 and a conductive shield 40 (see FIG. 8) covered on the housing 10 for electromagnetic interference (EMI) shielding.

Figure 4:
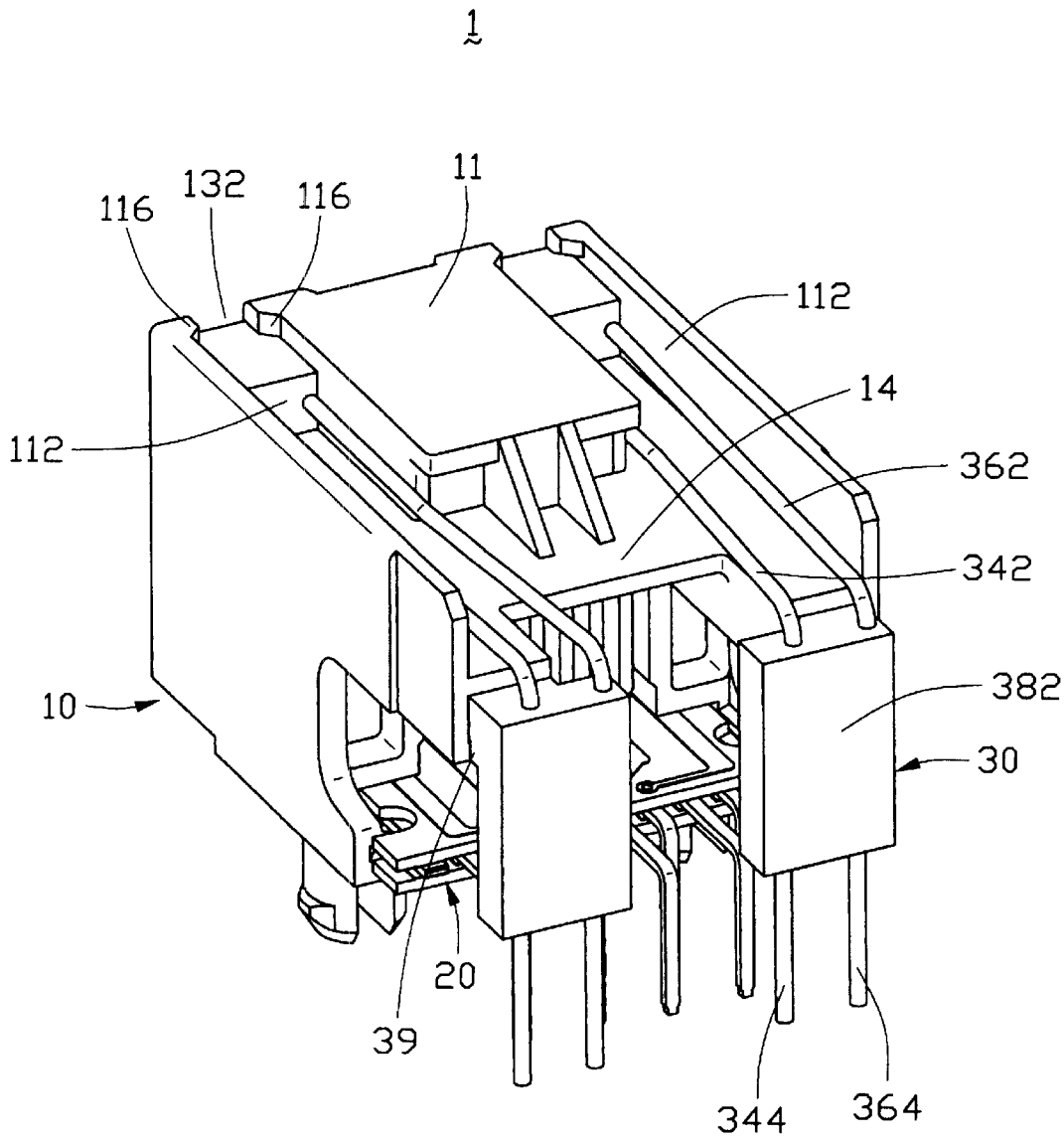
FIG. 4 is an assembled view of FIG. 1.
Figure 5:
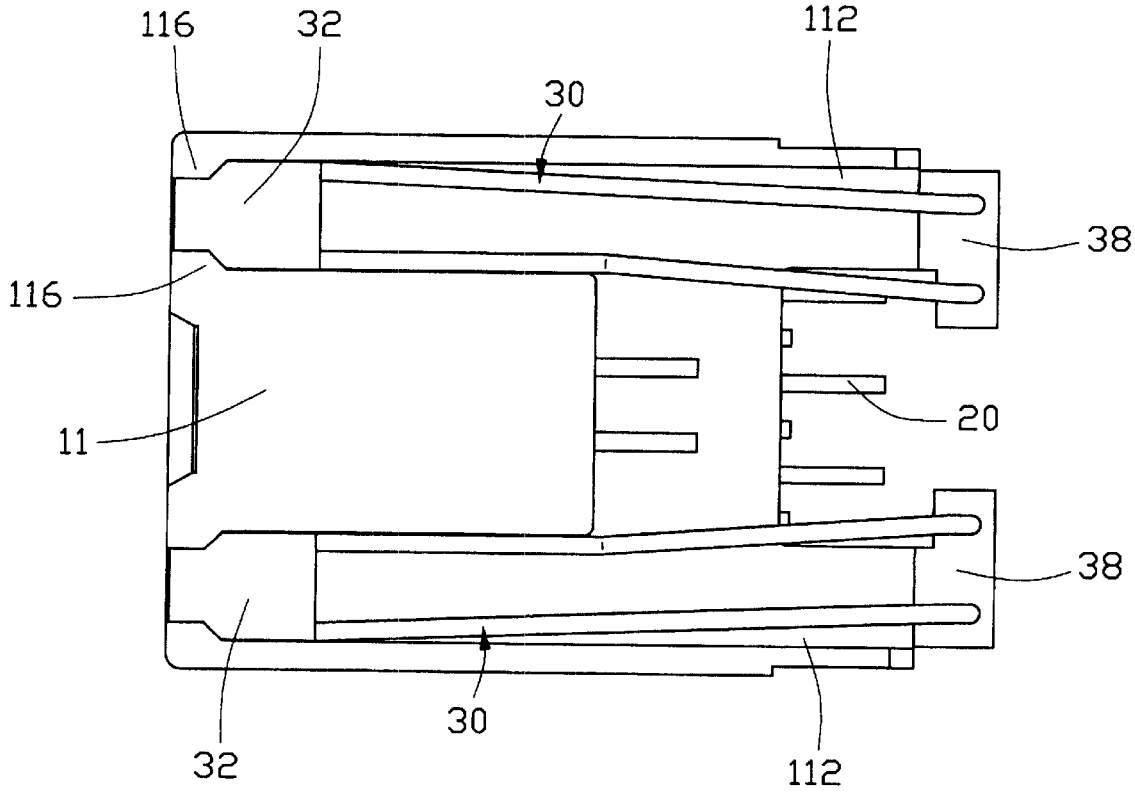
FIG. 5 is a top view of FIG. 4.
Figure 6:
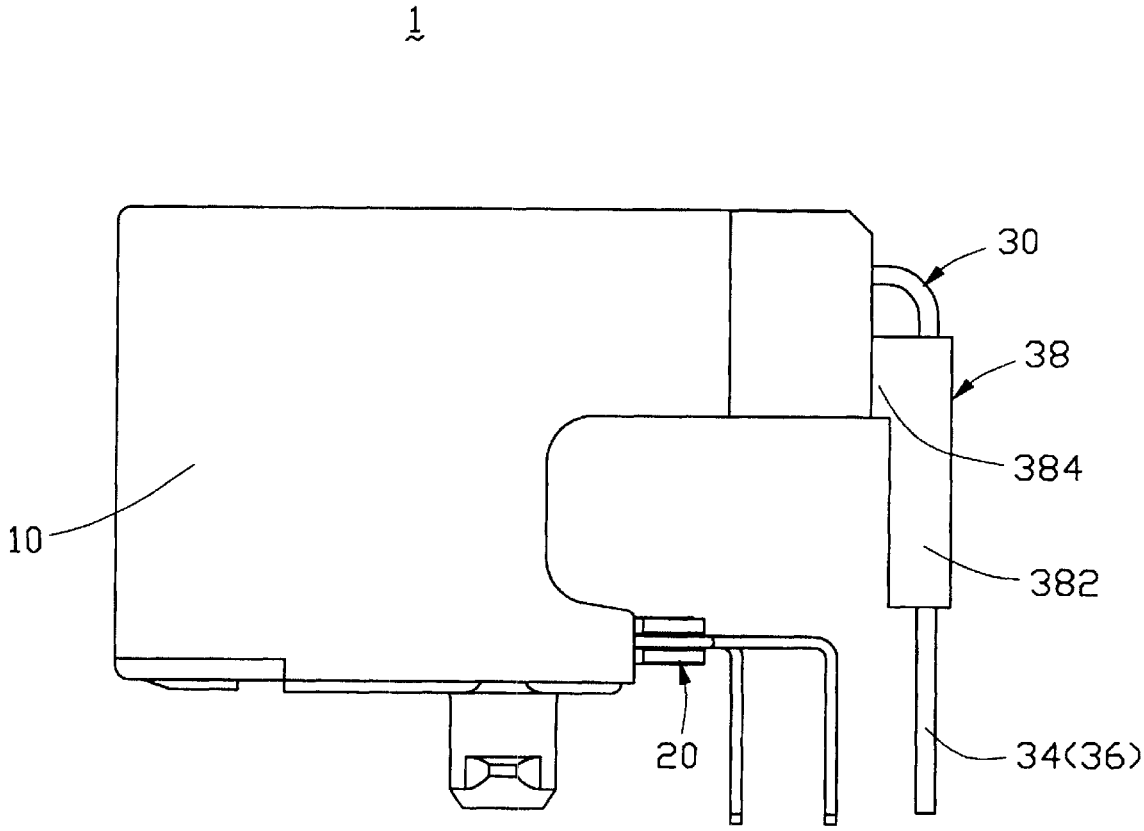
FIG. 6 is a side view of FIG. 4.
Figure 7:
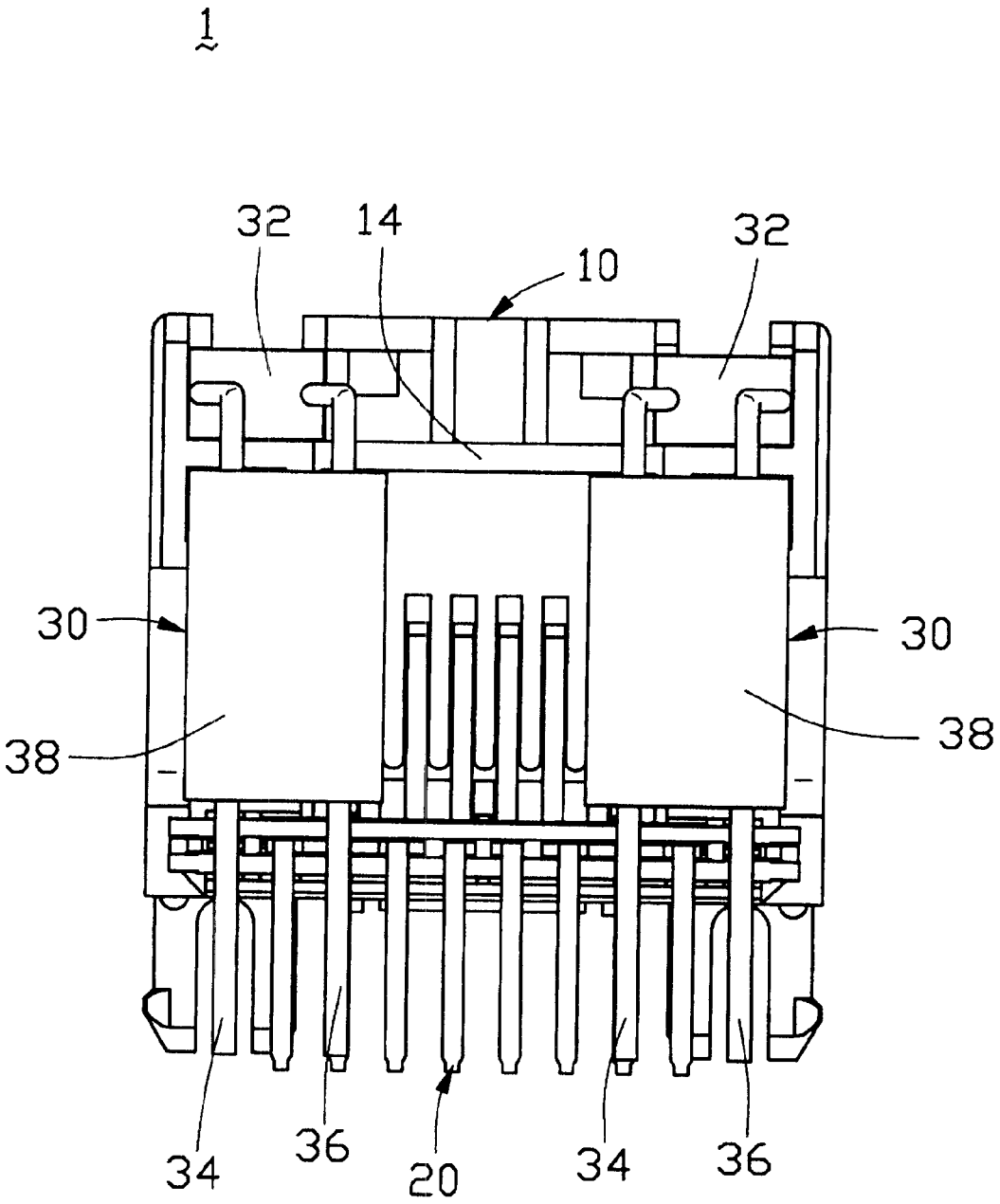
FIG. 7 is a back view of FIG. 4.

Further referring to FIG. 4, the dielectric housing 10 is in a rectangular shape and forms a top wall 14, a bottom wall 12, a front wall 13 and opposite side walls 15. The housing 10 is further integrally formed with a partition block 11 extending upwardly over the top wall 14. Both side walls 15 also extend over the top wall 14 to define a pair of channels 112, together with the top wall 14 and the partition block 11. The channels 112 open to the front wall 13 through a pair of apertures 132 thereof. A pair of projections 116 are formed on a front end of each channel 112. Furthermore, a pair of elongated blocks 16 extend rearward from opposite sides of the housing 10 and each is located below a corresponding channel 112. Each block 16 has a rear face 162 defining a rectangular hole 164 therein.

The terminal insert assembly 20 includes a plurality of terminals 22 and an upper and lower substrate 24, 26 with desired circuitry thereon and covering opposite sides of the terminal insert 22. A detail description about the terminal insert assembly 20 can be found in U.S. patent application Ser. No. 09/863942, titled "RJ Modular Connector Having Printed Circuit Board Having Conductive Trace To Balance Electrical Couplings Between Terminals" and commonly assigned to the same assignee of the present application. Alternatively, the terminal insert assembly can simply be a plurality of terminals as usual if controlled coupling between the terminals and the substrates is not desired.

Figure 2:
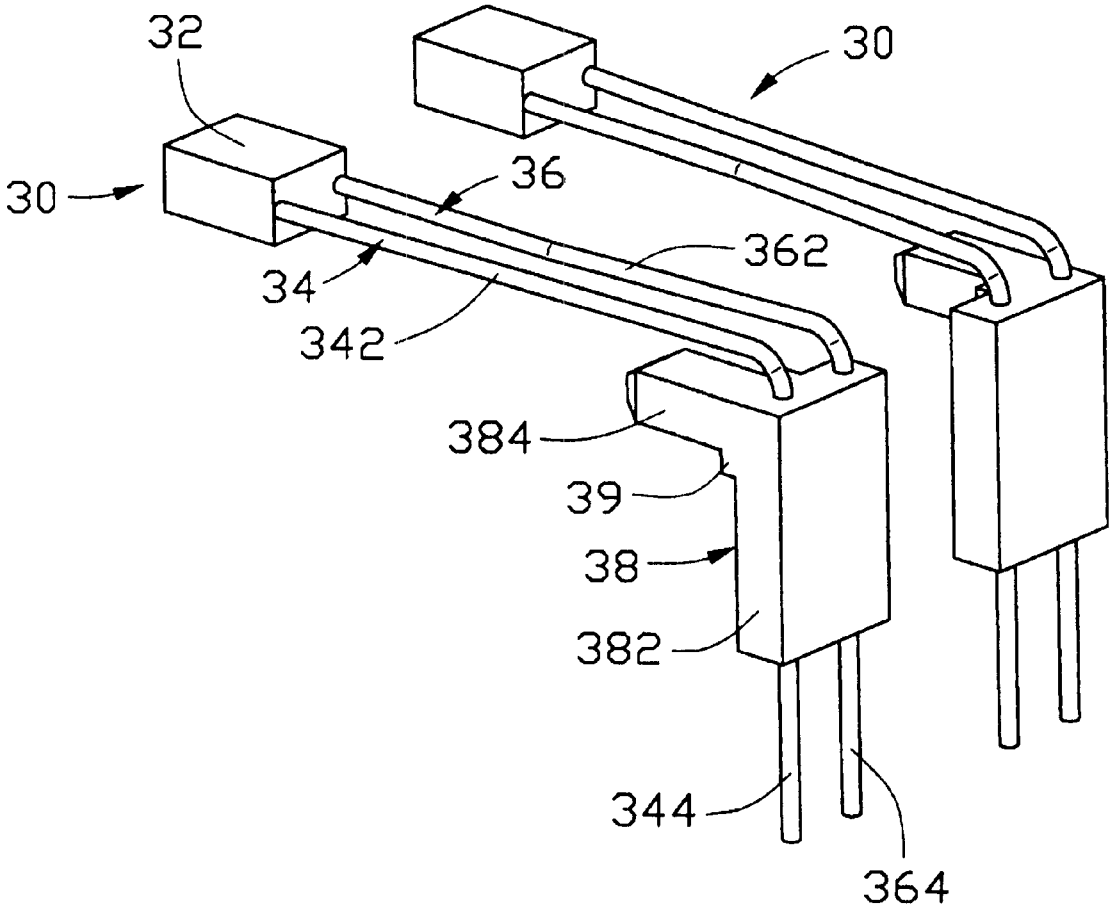
FIG. 2 is an enlarged perspective view of a pair of LED modules of the electrical connector of FIG. 1.
Figure 3:
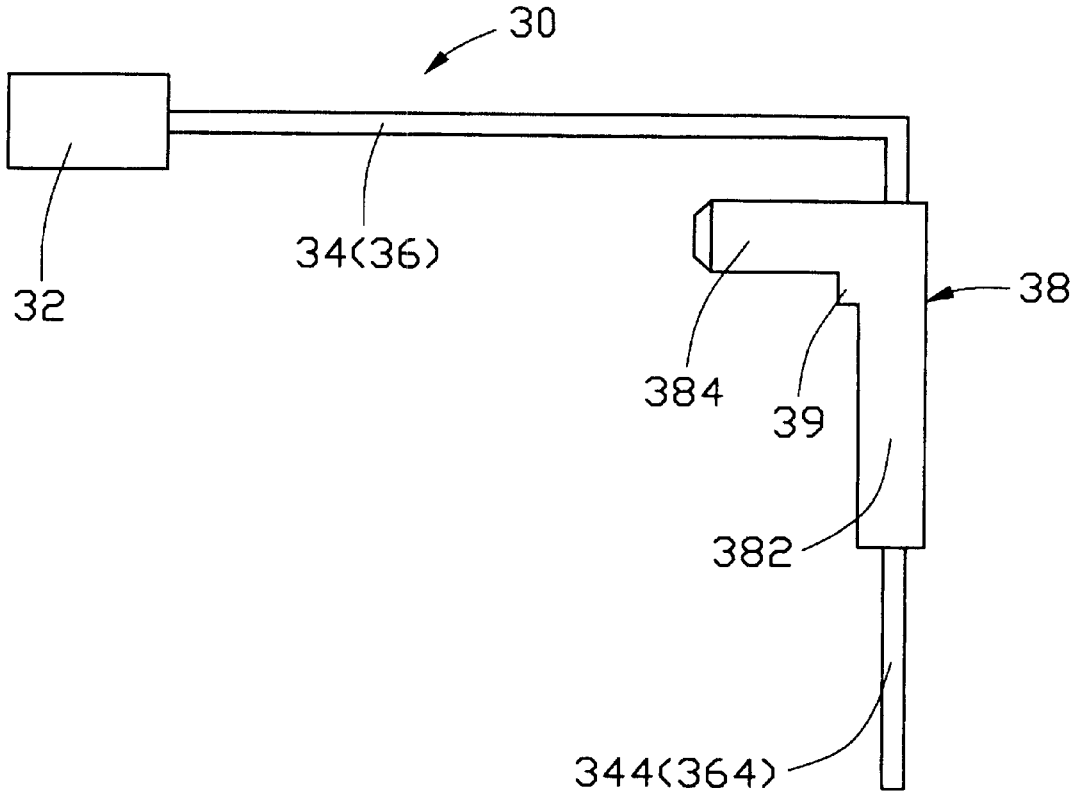
FIG. 3 is a side view of an LED of FIG. 2.

Referring to FIGS. 2 and 3, the pair of LED modules 30 are attached to housing 10 for providing visual status regarding the electrical connection of the connector 1 and have a symmetric structure with respect to each other, thus only a single LED 30 is described below. The LED 30 comprises a visual indicator 32, an anode lead wire 34 and a cathode lead wire 36 extending rearward from the visual indicator 32. The visual indicator 32 is a conventional design, may be either rectangular shaped or round shaped or of any other suitable geometric shape. The anode and cathode lead wires 34, 36 are parallel with each other, and each is in an "L" shape and forms a horizontal section 342 (362) and a vertical section 344 (364) normal to the former. Additionally, The vertical sections 344 and 364 are molded with a fixture 38 generally shaped in an "L" at upper portions thereof. The fixture 38 includes a vertical portion 382 combining with the vertical sections 344 and 364, and a horizontal portion 384 extending from an outer side of a top end of the vertical portion 382 for insertion into the rectangular hole 164 of a corresponding rectangular block 16 of the housing 10. Additionally, a rectangular standoff 39 is formed on an armpit of the fixture 38 for abutting against the rear face 162 of the block 16.

Figure 8:
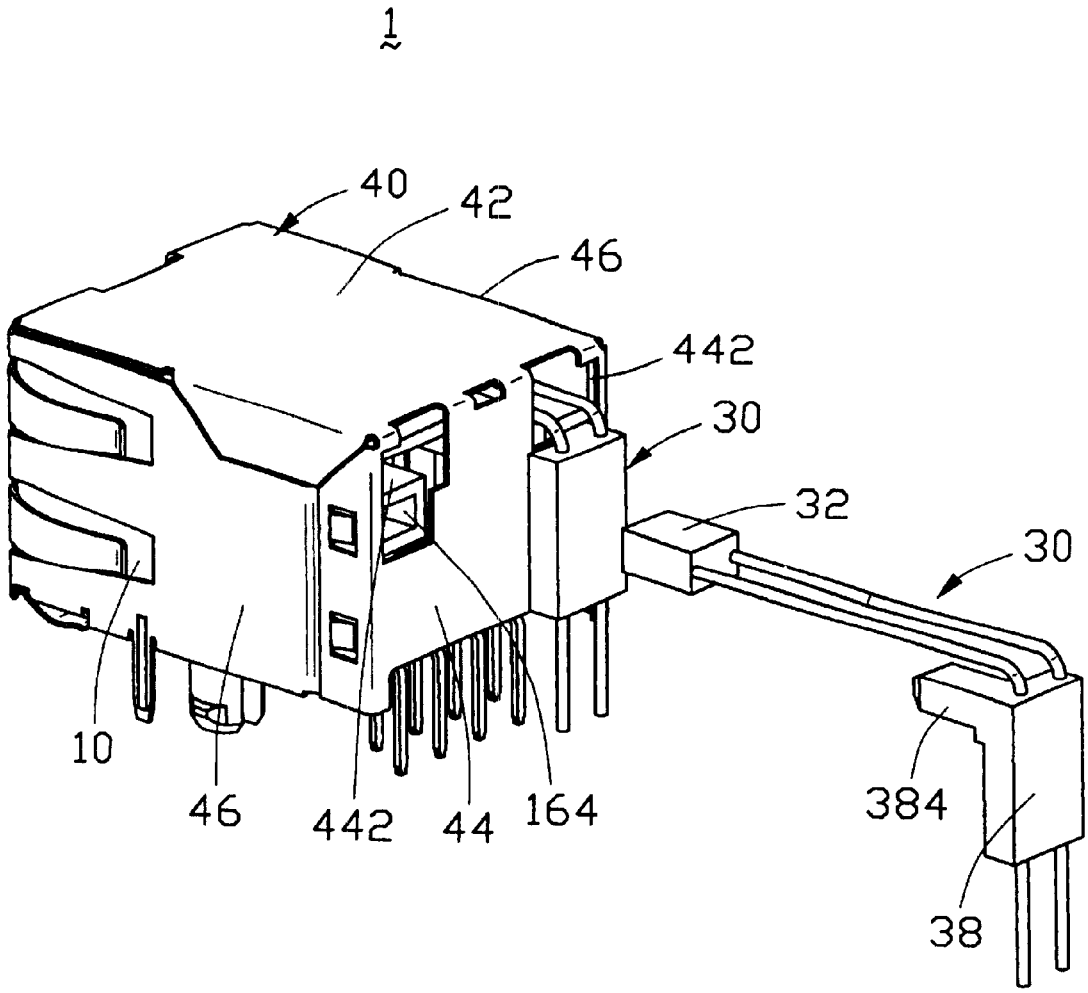
FIG. 8 is a partial assembled view of an electrical connector of FIG. 1 wherein a conductive shield is covered on the housing thereof.
Figure 9:
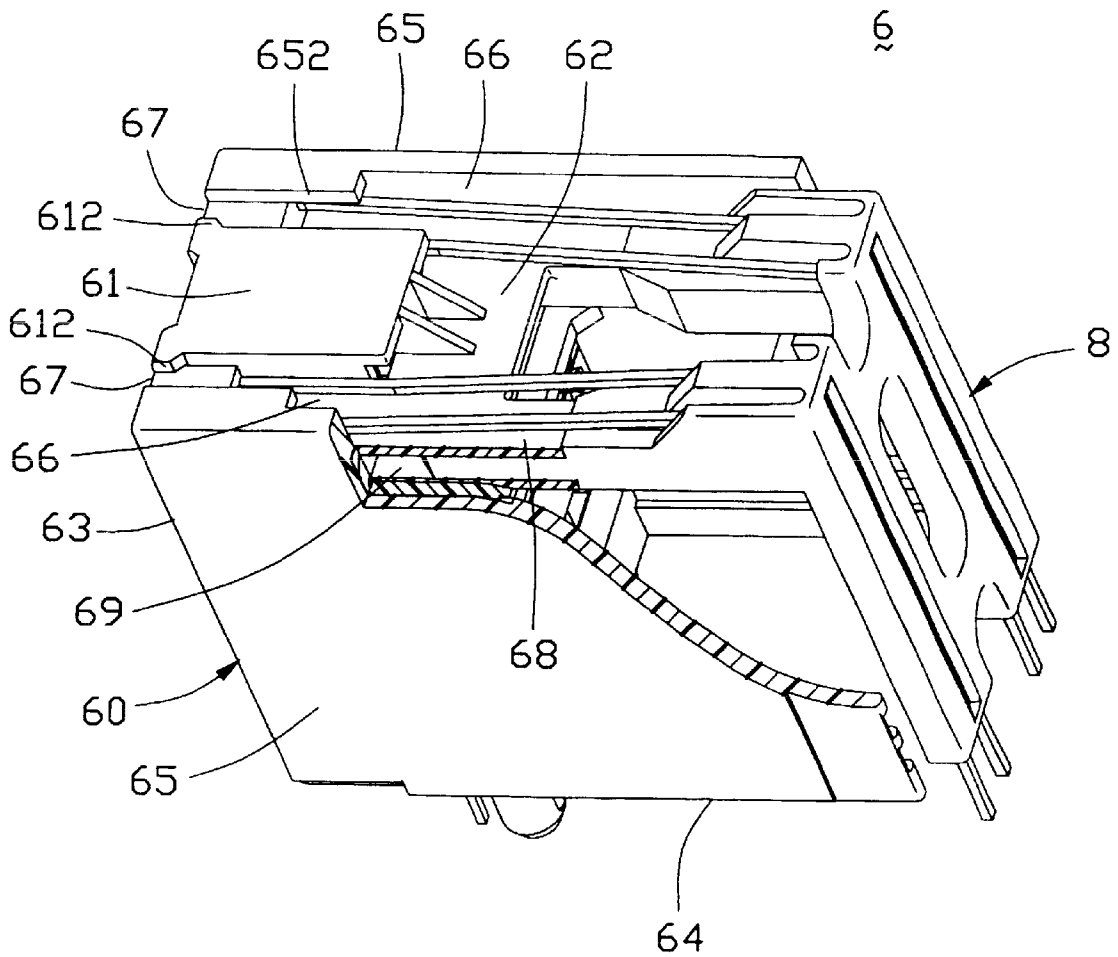
FIG. 9 is an assembled perspective view of an electrical connector in a second embodiment of the present invention.

Referring to FIG. 8, the conductive shield 40 comprises a top face 42, a rear face 44 and opposite side faces 46 which are cooperatively covered on the housing 10 to provide EMI shielding. The rear face 46 defines a pair of openings 442 for insertion of the LED modules 30.

In assembly, referring to FIGS. 4 to 7, a first method of assembling the exploded connector 1 is shown. After the terminal insert assembly 20 is retained into the housing 10, in the first prefer embodiment of the present invention, the pair of LED modules 30 are then inserted into corresponding channels 112 from the back of the housing 10. The visual indicator 32 is generally aligned with the aperture 132 and restrained by the corresponding projections 116. The horizontal sections 342, 362 of each LED 30 are received in a corresponding channel 112. Additionally, The horizontal portion 384 of each LED 30 is captured by the rectangular hole 164 of a corresponding block 16 and can be further retained by some conventional means, like retaining bumps formed on the horizontal portion 384. The standoff 39 abuts against the rear face 162 of a corresponding block 16 of the housing 10. Using this arrangement, the LED modules 30 are prevented from moving or vibration by the horizontal portion 384 during arrangement or transportation. At last, the conductive shield 40 is covered onto the housing 10.

A second method of assembling the exploded connector 1 is shown in FIG. 8. After the terminal insert assembly 20 is fitted into the housing 10, the conductive shield 40 is then covered onto the housing 10. At last, the pair of LED modules 30 are inserted into the corresponding channels 112 from the openings 442 of the conductive shield 40. At the same time, the horizontal portions 384 of the LED modules 30 are captured by corresponding rectangular holes 164 of the housing 10, thereby safely retaining the LED modules 30 in the housing 10 without movement or vibration. Accordingly, the LED modules 30 may be assembled with the housing 10 before or after the conductive shield 40 is covered onto the housing 10 as desired but achieve the same reliable arrangement.

Referring to FIGS. 9 to 12, an RJ type modular connector 6 in accordance with a second embodiment of the present invention is shown. The modular connector 6 comprises a dielectric housing 60, a terminal insert assembly (not shown) retained in the housing 60 and an LED assembly 8 assembled with the dielectric housing 60.

Figure 10:
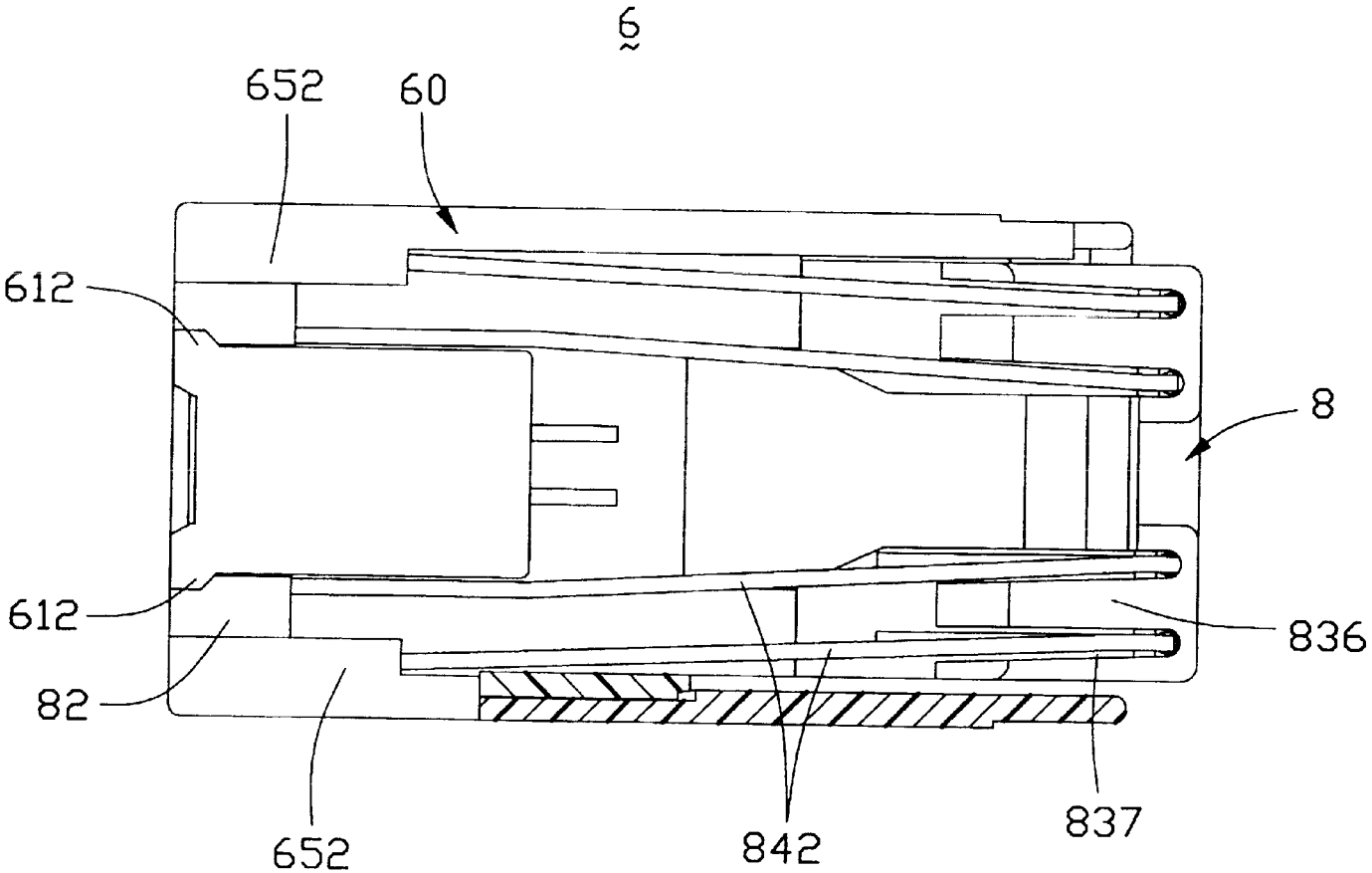
FIG. 10 is a top view of FIG. 9.
Figure 11:
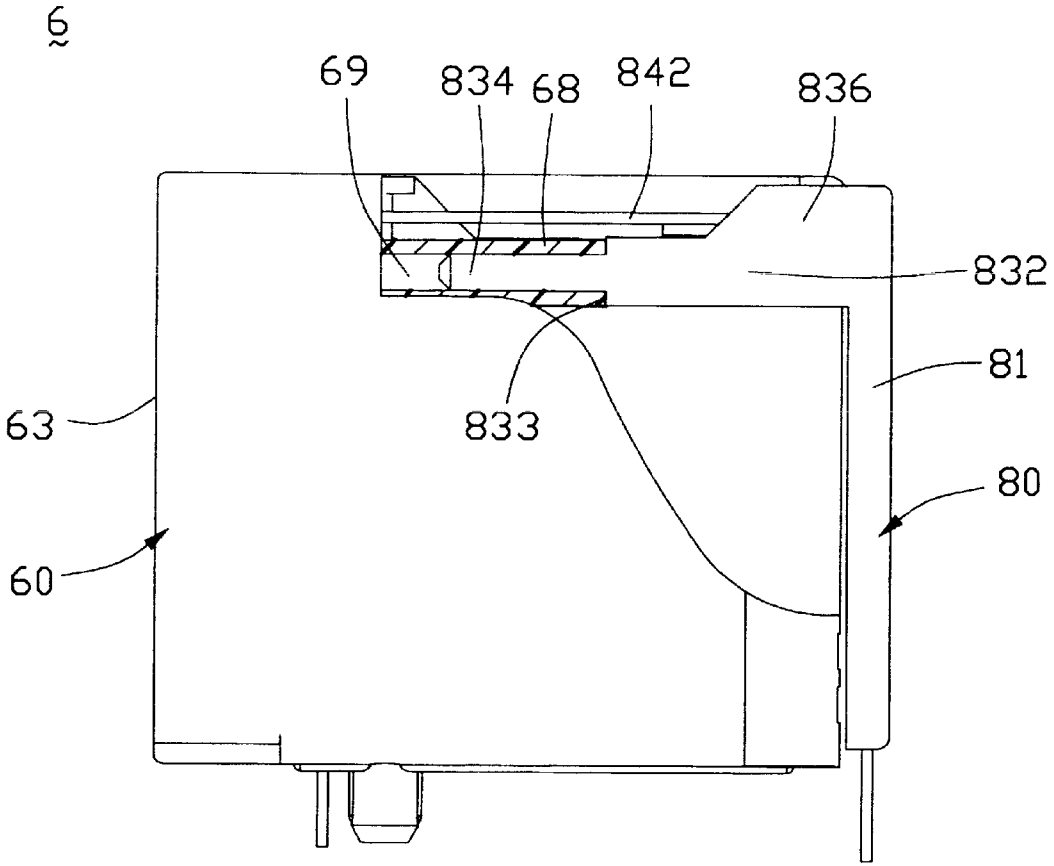
FIG. 11 is a side view of FIG. 9.

Further referring to FIGS. 10 and 11, the dielectric housing 60 has a similar structure as that of the modular connector 1 in the first embodiment and also has a top wall 62, a bottom wall 64, a front wall 63 and opposite side walls 65. The housing 60 is further integrally formed with a partition block 61 extending upwardly over the top wall 62. Both side walls 65 also extend over the top wall 62 to define a pair of channels 66, together with the top wall 62 and the partition block 61. The channels 66 is opened to the front wall 63 through a pair of apertures 67 thereof. The partition block 61 forms a pair of projections 612 on a front side thereof and the side walls 65 form a pair of protrusions 652 each facing an adjacent projection 612. Furthermore, a pair of elongated blocks 68 extend rearward from opposite sides of the housing 60 and each block 68 defines a hole 69 in a rear face (not labeled) thereof.

Figure 12:
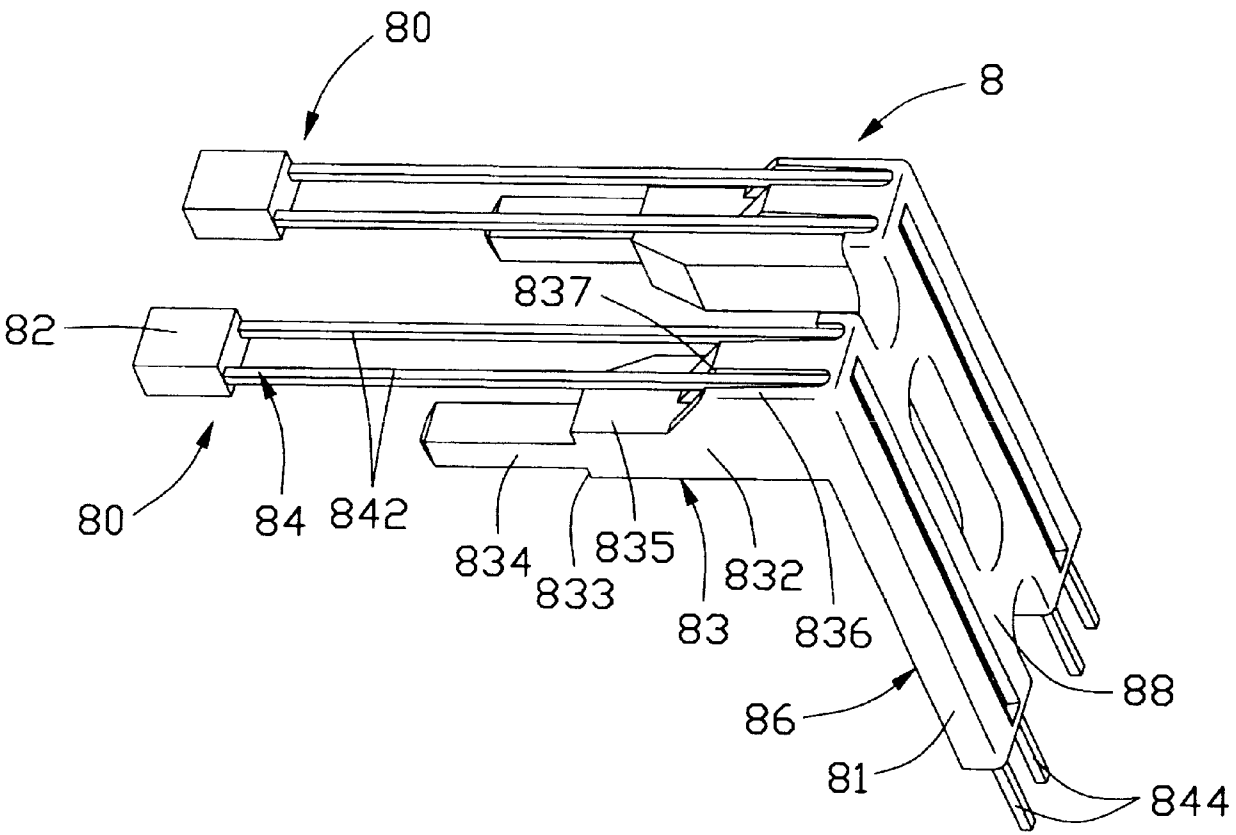
FIG. 12 is a perspective view of a LED module of the electrical connector in FIG. 9.

Further referring to FIG. 12, the LED assembly 8 is assembled with the housing 60 in a back-to-front direction and has a pair of LEDs 80 which are symmetric with each other. Each LED 80 includes an visual indictor 82, a pair of lead wires 84 extending rearward from the visual indicator 82, and a fixture member 86 fastened to the lead wires 84. The visual indicator 82 is restrained by the projection 612 of the partition block 61 and an adjacent protrusion 652 facing the projection 612, and is viewed through a corresponding aperture 67. The lead wires 84 are positioned in a corresponding channel 66 of the housing 60 and each lead wire 84 has a horizontal section 842 and a vertical section 844 to be soldered to an underlying circuit board (not shown). The horizontal section 842 is resilient and can be freely bent with respect to the vertical section 844. As best seen in FIG. 10, after the LED assembly 8 is assembled with the housing 60, the horizontal sections 842 of the lead wires 84 of one LED 80 bend outward a little with respect to those of the other LED 80 for compensating the offset arrangement between the lateral positions where the vertical sections 844 are located to be soldered to corresponding layouts of the circuit board and the position where the corresponding visual indicator 82 is located. The fixture member 86 is in an "L" shape and comprises a vertical portion 81 connected with the vertical sections 844, and a horizontal portion 83 normal to the vertical portion 81. The horizontal portion 83 has a first section 832 and a second section 834 extending forwardly from a front side 833 of the first section 832. The first section 832 has a projection 836 at an upper portion thereof and the projection 836 defines a slot 837 for partially receiving the horizontal section 842 of a corresponding lead wire 84 therein. The second section 834 is fixedly inserted into a corresponding hole 69 of the housing 60. Additionally, the LED assembly 8 further has a middle bridge 88 which is integrally formed with the fixture members 86 to connect the pair of LEDs 80 together, and is flush with the vertical portions 81 of the fixture members 86. Using this arrangement, the LED assembly 8 can be freely and reliably assembled with the housing 60 and can not offset or move during assembly or transportation, as well as the LEDs 30 in the first embodiment of the present invention.

One advantage of the invention is to provide the LED assembly with the fixture member holding the wires of the LED wherein because the horizontal section of the wire is free to be deflected relative to the vertical section for compensating the lateral offset between the distal tail mounting end of the wire which complies with the layout of the printed circuit board on which the connector is mounted, and the visual indicator which complies with the housing structure of the connector, the wire does not require to intentionally be bent offset for the same purpose, thus easing the manufacturing procedure. Additionally, because the vertical section of the wire is kept straight, it allows to have the vertical sections of the wires inserted into the formed fixture member in a traditional way rather than an expensive/complicate insert molding procedure where a structural offset on the wire can be secured thereto. Thus, lateral deflectability of the horizontal section of the wire relative to the fixture member and straight structure of the vertical section of the wire ease manufacturability of the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An RJ type modular connector for receiving a plug to form an electrical connection in data communication application, comprising:

an insulative housing defining a pair of channels and having a pair of blocks on opposite sides thereof, each block defining a hole at a rear face thereof;

a plurality of terminals being retained in the housing; and at least one light emitting diode (LED) module being fitted with the channel of the insulative housing and having an indicator, lead wires extending rearward from the indicator, and a fixture member integrally formed with the wires, the fixture member having a horizontal portion captured by the hole of a corresponding block to retain the LED module in the housing.

2. The RJ type modular connector as claimed in claim 1, wherein each of the lead wires of the LED module is in an "L" shape and comprises a horizontal section and a vertical section, and wherein the fixture member further includes a vertical portion normal to the horizontal portion and located on the vertical sections of the lead wires.

3. The RJ type modular connector as claimed in claim 2, wherein the horizontal portion of fixture member extends from an upper end of the vertical portion.

4. The RJ type modular connector as claimed in claim 3, wherein a standoff is formed between the vertical portion and the horizontal portion of the fixture member for abutting against the rear face of the block.

5. The RJ type modular connector as claimed in claim 1, wherein the insulative housing has a front wall which defines a pair of apertures communicating with corresponding channels for viewing the indicators of the LED modules fitted with the housing.

6. The RJ type modular connector as claimed in claim 1, wherein at least one projection is formed on a front end of each channel for restraining the indicator of each LED module.

7. The RJ type modular connector as claimed in claim 1, further comprising a conductive shield which covers the housing after the LED modules are assembled with the housing.

8. The RJ type modular connector as claimed in claim 1, further comprising a conductive shield which covers the housing before the LED module is assembled with the housing and having a rear face defining a pair of openings for insertion of the LED module.

9. The RJ type modular connector as claimed in claim 1, further comprising an upper and lower substrate sandwiching the plurality of terminals to form a terminal insert assembly.

10. An RJ type modular connector for receiving a plug to form an electrical connection in data communication application, comprising:

an insulative housing defining a pair of channels and having a pair of blocks on opposite sides thereof, each block defining a hole at a rear face thereof;

a plurality of terminals being retained in the housing for mating with the plug; and a light emitting diode (LED) module being assembled to the channels along a back-to-front direction with respect to the housing and being integrally formed with a fixture member, the fixture member having a retaining section captured within one of the holes of the housing.

11. The RJ type modular connector as claimed in claim 10, wherein the LED module includes a pair of LEDs and each LED includes a visual indicator, a pair of lead wires extending rearward from the visual indicator and a retaining member connecting with the lead wires.

12. The RJ type modular connector as claimed in claim 11, wherein each lead wire has a horizontal section and a vertical section bending downward from the horizontal section for soldering to a circuit board, and the horizontal section is resilient so as to be freely bent with respect to the vertical section.

13. The RJ type modular connector as claimed in claim 11, wherein the retaining member is formed with a horizontal portion and a vertical portion extending from the horizontal portion and connecting with the vertical sections of the lead wires.

14. The RJ type modular connector as claimed in claim 13, wherein the horizontal portion of the retaining member has a first section and said retaining section extending forward from a front side of the first section.

15. The RJ type modular connector as claimed in claim 10, wherein the first section forms a projection at an upper portion thereof and the projection defines a slot partially receiving the horizontal section of a corresponding lead wire.

16. The RJ type modular connector as claimed in claim 10, wherein the LED module further has a bridge portion integrally formed between the retaining members to connect the pair of LEDs thereof together.

17. An electrical connector comprising:

an insulative housing defining at least a channel around a top portion thereof;

a plurality of terminals disposed in the housing;

an LED module being assembled to the housing, said LED module including:

an indicator positioned at a front end of the channel around a front face of the housing;

a pair of wires extending rearwardly from said indicator; and a fixture member holding said pair of wires;

each of said wires including a straight vertical section extending through said fixture member, and a deflectable horizontal section positioned between the indicator and said vertical section; wherein said horizontal section is guidably laterally deflectable relative to the fixture member for compensating an offset between the indicator and distal mounting ends of the vertical sections of the wires in a lateral direction of the housing.

18. The connector as claimed in claim 17, wherein said the vertical section extends in a vertical direction of the housing and the LED module is assembled to the housing in a back-to-front direction perpendicular to both said lateral direction and said vertical direction.

19. An electrical connector comprising:

an insulative housing defining at least a channel around a top portion thereof;

a plurality of terminals disposed in the housing;

an LED module being assembled to the housing, said LED module including:

an indicator positioned at a front end of the channel around a front face of the housing;

a pair of wires extending rearwardly from said indicator; and a fixture member holding said pair of wires;

each of said wires including a vertical section extending through said fixture member around a rear portion of the housing, and a horizontal section positioned between the indicator and said vertical section around the top portion of the housing; wherein the LED module is assembled to the housing in a back-to-front direction with a holding device formed on the fixture member and retaining the LED module in position in the housing either before or after a shield is applied upon the housing.

* * * * *